United States Patent [19]

Fujimoto

[11] 4,418,904

[45] Dec. 6, 1983

[54] SHEET FEEDING APPARATUS

[75] Inventor: Sakae Fujimoto, Chofu, Japan

[73] Assignee: Ricoh Company, Ltd., Tokyo, Japan

[21] Appl. No.: 181,631

[22] Filed: Aug. 26, 1980

[30] Foreign Application Priority Data

Aug. 27, 1979 [JP] Japan ..... 54-108873

[51] Int. Cl.[3] ..... B65H 3/06; B65H 3/52; B65H 3/54

[52] U.S. Cl. ..... 271/37; 271/116; 271/124; 271/165

[58] Field of Search ..... 271/121, 124, 118, 37, 271/38, 10, 165, 166, 160, 116, 122, 125, 35, 34, 114, 110, 111, 307, 312, DIG. 2, 264, 278

[56] References Cited

U.S. PATENT DOCUMENTS

| | | | |
|---|---|---|---|
| 1,046,245 | 12/1912 | Zeitz | 271/DIG. 2 |
| 2,726,862 | 12/1955 | Anderson | 271/124 |
| 2,938,722 | 5/1960 | Luning | 271/165 X |
| 3,575,410 | 4/1971 | Suzuki | 271/111 |
| 3,838,851 | 10/1974 | Koubas | 271/116 X |
| 3,861,670 | 1/1975 | Kraft | 271/125 X |
| 3,895,790 | 7/1975 | Hoyer et al. | 271/118 X |
| 3,933,350 | 1/1976 | Mignano | 271/37 X |
| 3,991,998 | 11/1976 | Banz et al. | 271/125 |
| 4,155,546 | 5/1979 | Jacobs | 271/165 X |
| 4,284,269 | 8/1981 | Ignatjev | 271/165 X |

FOREIGN PATENT DOCUMENTS

| | | | |
|---|---|---|---|
| 2320319 | 12/1973 | Fed. Rep. of Germany . | |
| 55-52835 | 4/1980 | Japan | 271/121 |

*Primary Examiner*—Bruce H. Stoner, Jr.

*Attorney, Agent, or Firm*—Wyatt, Gerber, Shoup, Scobey & Badie

[57] ABSTRACT

A sheet feeding apparatus of the type capable of feeding sheets individually from the lowermost sheet of a stack of sheets placed on a sheet tray, for use in facsimile apparatus, a copying machine or the like, comprises a sheet feed roller rotated in the sheet feeding direction and a sheet separation roller also rotated in the sheet feeding direction and disposed downstream of a sheet feed roller in terms of the sheet feeding direction. A brake member is in contact with the peripheral surface of the sheet separation roller and a pressure application plate is disposed above the sheet feed roller to bring the sheets into pressure contact with the sheet feed roller. The pressure application plate is movable between its pressure application position and a position substantially away from the sheets whereby the pressure plate may be held away from the sheets when they are being driven by the sheet separation rollers. Stopper members for causing the leading edges of the sheets to collide therewith are disposed in a sheet feed path between the brake member and sheet feed roller and the stopper member allow a limited number of sheets to pass towards the brake member. The stopper member is movable to a position where it is away from the sheet separation roller for removing jammed sheets.

31 Claims, 19 Drawing Figures

SHEET FEEDING APPARATUS

BACKGROUND OF THE INVENTION

The present invention relates to a sheet feeding apparatus capable of feeding sheets individually for use in a facsimile apparatus, a copying machine or the like.

A variety of sheet feeding apparatus have been proposed for use in a facsimile apparatus or the like, which are capable of feeding original documents individually into a section of the facsimile apparatus which optically reads the original documents.

A conventional sheet feeding apparatus comprises a sheet separation roller which is rotated in the direction for feeding the sheets, a brake member which is in contact with the peripheral surface of the sheet separation roller and a sheet feed roller which is also rotated in the sheet feeding direction and is disposed in a sheet feeding path upstream of the sheet separation roller in terms of the sheet feeding direction. By these structures a plurality of original documents can be fed between the sheet separation roller and the brake member by the sheet feed roller, and the brake member serves to retard the movement for all the original documents, except the original document located closest to the sheet separation roller, so that only the original document located closest to the sheet separation roller is allowed to pass between the brake member and the sheet separation roller.

In a sheet feeding apparatus of the above-mentioned type, it has been proposed to dispose a pressure plate for bringing the original documents into pressure contact with the sheet feed roller in order to feed the original documents securely between the sheet separation roller and the brake member by increasing the friction between the original documents and the sheet feed roller.

Naturally, sheet feeding can be performed more securely when the sheets, such as original documents, are fed while they are brought into pressure contact with the sheet feeding roller. However, bringing the sheets into pressure contact with the sheet feed roller increases the load applied to the sheet separation roller during sheet feeding, so that the sheet separation performance of the sheet separation roller decreases, and misfeeding such as double feeding of the sheets is apt to occur. Further, even if the sheet feed roller and the sheet separation roller are designed so as to be driven in synchronization with each other, it may be impossible to rotate the two rollers at exactly the same speed in practice, due to inevitable errors. If the sheets are transported by both the sheet feeding roller and sheet separation roller and some unbalance occurs in their rotation speeds, each sheet may be loosened between the two rollers, resulting in wrinkles in the sheet, or too much tension may be applied to the sheet so that the sheet may be torn.

Further, in the above-mentioned type of sheet feeding apparatus, if the sheets are individually and successively fed between the sheet separation roller and the brake member, the sheet separation and feeding can be performed successively. However, if a sheet is curled upward for some reason in the course of sheet feeding, it may not be fed between the sheet separation and the brake member, resulting in the sheet separation and feeding not being performed and the sheet jamming.

Further, in the above-mentioned type sheet feeding apparatus, when a plurality of original documents are placed in the apparatus, all the original documents are caused to collide with the brake member at the same time. However, in order to stop the movement of the original documents, the brake member has to be brought into pressure contact with the peripheral surface of the sheet separation roller by applying great forces to the brake member. Such high pressures applied to the peripheral surface of the sheet separation roller by the brake member may abrade the sheet separation roller and the brake member, and when the sheets are not stiff enough, sheet jamming may occur without the sheet separation being performed.

Further, in the above-mentioned type of sheet feeding apparatus, when the original documents collide with the brake member, the original document transported closest to the sheet separation roller is momentarily stopped, and if the original sheets are continuously transported forcibly by the sheet feeding roller under such circumstances, the original documents may be wrinkled and damaged, particularly when the number of the original document are few.

Further, in the above-mentioned type sheet feeding apparatus, if sheet jamming occurs between the sheet separation roller and the brake member, great forces may be required to remove the jammed original document due to a comparatively great friction between the jammed original document and the brake member, and there is a risk that the original document may be torn when removing it.

SUMMARY OF THE INVENTION

It is therefore a general object of the invention to provide an improved sheet feeding apparatus with the aforementioned shortcomings of the conventional sheet feeding apparatus eliminated.

More specifically, the first object of the invention is to provide an improved sheet feeding apparatus in which sheets are brought into pressure contact with a sheet feeding roller by a pressure application member before the sheets are inserted between a sheet separation roller and a brake member, and the sheets inserted between the sheet separation roller and the brake member are transported by the sheet separation roller, whereby the friction between the sheets and the sheet feeding roller is increased in a manner avoiding excess load being applied to the sheets by the sheet separation roller in the course of sheet transportation, and improving the sheet separation performance of the sheet separation roller.

The first object of the invention is attained by sheet feeding apparatus of the above-mentioned type in which the pressure application member is disposed so as to be movable between a sheet contact position where the sheets are brought into pressure contact with the sheet feed roller and a position substantially away from the sheet contact position, and there is provided a pressure application member drive device for holding the pressure application member at the sheet contact position until the sheets are inserted between the sheet separation roller and the brake member.

The second object of the invention is to provide a sheet separation apparatus capable of feeding sheets by preventing sheet jamming even if the sheets fed between the sheet separation roller and the brake member are curled, for instance, upwards.

The second object of the invention is attained by a sheet feeding apparatus of the above-mentioned type comprising a sheet separation roller which is rotated in the sheet feeding direction, a brake member which is in contact with the peripheral surface of the sheet separation roller, a sheet feed roller which is also rotated in the sheet feeding direction and is disposed in a sheet feeding path upstream of the sheet separation roller in terms the sheet feeding direction, and guide members which are disposed on the opposite sides of the brake member and which guide the sheets between the sheet separation roller and the brake member.

The third object of the invention is to provide a sheet feeding apparatus capable of feeding sheets individually, in which even if a plurality of sheets are placed in the sheet feeding apparatus, all of them are not caused to collide with the brake member so that the friction between the brake member and the sheet separation roller can be minimized, whereby it is unnecessary to bring the brake member into pressure contact with the sheet separation roller by great forces.

The third object of the invention is attained by a sheet feeding apparatus of the above-mentioned type comprising a sheet separation roller which is rotated in the sheet feeding direction, a brake member which is in contact with the peripheral surface of the sheet separation roller, a sheet feed roller which is also rotated in the sheet feeding direction and is disposed in a sheet feeding path upstream of the sheet separation roller in terms of the sheet feeding direction, and a stopper member which is disposed between the brake member and the sheet feed roller, the stopper member allowing a limited number of sheets to pass therethrough in the direction of the sheet separation roller.

In the above-mentioned sheet feeding apparatus, even if a plurality of sheets are placed in the sheet feeding apparatus, movement of most of the sheets are hindered by the stopper member and only a limited number of sheets pass under the stopper member and reach the brake member and the sheet separation roller. Therefore, great forces are not required for bringing the sheets into pressure contact with the sheet separation roller by the brake member, so that it is possible to separate securely sheets which are not very stiff. Furthermore, abrasion of the sheet separation roller and the brake member can be reduced significantly.

The fourth object of the invention is to provide a sheet feeding apparatus capable of preventing the sheets from being wrinkled even if the number of sheets in the apparatus is limited.

The fourth object of the invention is attained by a sheet feeding apparatus of the above-mentioned type comprising a sheet separation roller which is rotated in the sheet feeding direction, a brake member which is in contact with the peripheral surface of the sheet separation roller, a plurality of sheet feeding rollers which are also rotated in the sheet feeding direction and which are disposed with a predetermined space therebetween in the axial direction thereof, crossing a sheet feeding path located upstream of the sheet separation roller in terms of the sheet feeding direction, a pressure member which is disposed so as to face the sheet feed rollers and which is movable in the direction towards the sheet feed rollers and also movable in the direction away from the sheet feed rollers, said pressure plate being out of contact with the sheet feed roller when it is brought near the sheet feed rollers and having projections extending between the sheet feed rollers and below the peripheral surface of each sheet feed roller.

The fifth object of the invention is to provide a sheet feeding apparatus from which jammed sheets can be easily removed if the sheet jamming occurs, preventing damage of the sheets.

The fifth object of the invention is attained by a sheet feeding apparatus of the above-mentioned type comprising a sheet separation roller which is rotated in the sheet feeding direction, a sheet feeding roller which is also rotated in the sheet feeding direction and is disposed in a sheet feeding path upstream of the sheet separation roller in terms of the sheet feeding direction, a brake member movable between a brake operating position where the brake member is in contact with the peripheral surface of the sheet separation roller and brake non-operating position where the brake member is out of contact with the peripheral surface of the sheet separation roller, a brake drive apparatus for moving the brake member between the brake operating position and the brake non-operating position, said brake drive apparatus being constructed so as to move the brake member to the brake non-operating position when sheet jamming occurs.

In the sheet feeding apparatus, when sheet jamming occurs, the brake member can be moved to the brake non-operating position, which is away from the sheet separation roller. Therefore, sheets jammed between the brake member and the sheet separation roller can be removed easily.

DETAILED DESCRIPTION OF THE PREFERRED EMBODIMENT

Figure 1:
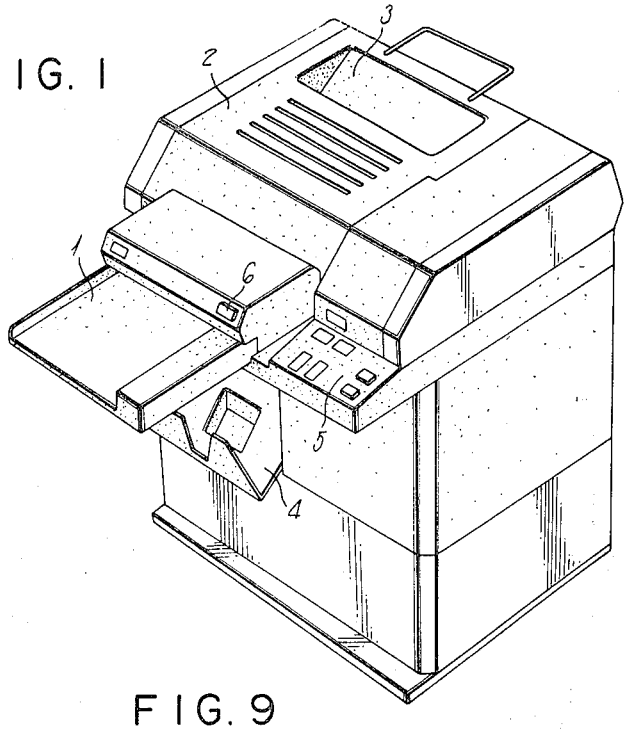
FIG. 1 is a perspective view of a facsimile apparatus in which an embodiment of a sheet feeding apparatus according to the invention is employed.

Referring to FIG. 1, there is perspectively shown a facsimile apparatus in which a sheet feeding apparatus according to the invention is employed. In this facsimile apparatus, an original tray 1 for stacking original documents thereon is disposed in the front portion of the sheet feeding apparatus. The original documents stacked on the original tray 1 are individually fed into the facsimile apparatus by the sheet feeding apparatus and are individually detected photoelectrically when they pass over a read section 2. The original documents are then discharged from the facsimile apparatus through an original document outlet 3. The facsimile apparatus is also provided with a stacker 4 for stacking recording sheets thereon. In FIG. 1, reference numeral 5 represents an operation panel for controlling the transmission operation of the facsimile apparatus. Reference numeral 6 represents a button of the sheet feeding apparatus for initiating continuous feeding of the sheets in the tray 1 automatically.

Figure 2:
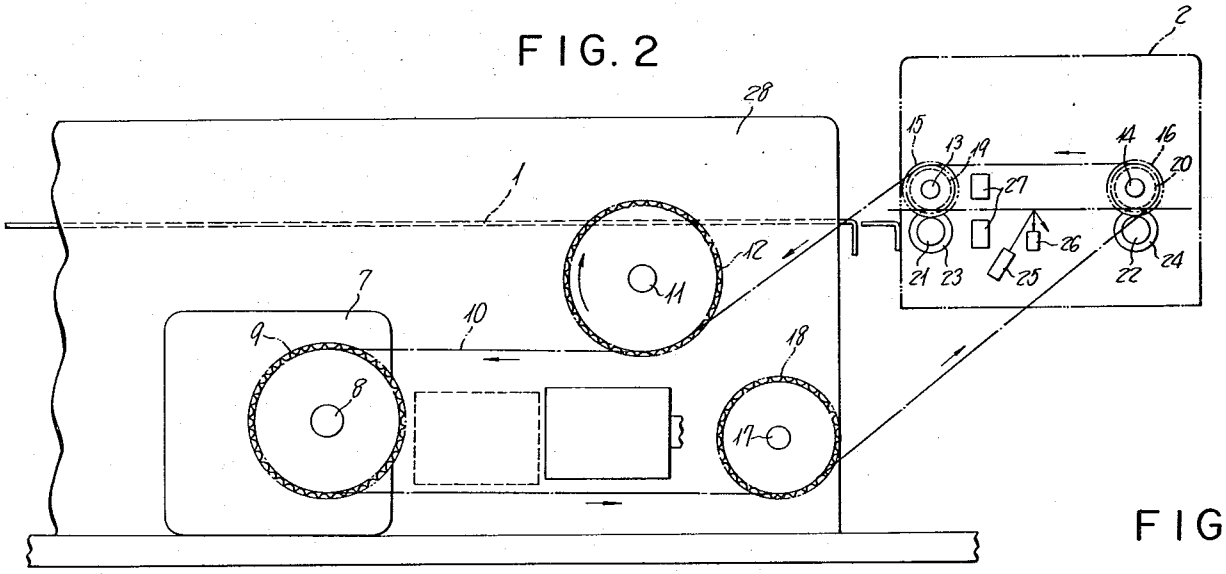
FIG. 2 is a schematic view of a drive system for the sheet feeding apparatus according to the invention and the facsimile apparatus.

FIG. 2 shows a side view of a drive system of the sheet feeding apparatus according to the invention. In FIG. 2, reference numeral 7 represents a motor. The motor 7 has a rotating shaft 8, to which a sprocket 9 is fixed. An endless chain 10 is trained over the sprocket 9, a sprocket 12 which is fixed to a roller drive shaft 11, and an idle sprocket 18 which is rotatably supported on a shaft 17 fixed to a side plate 28. The endless chain 10 is continuously rotated in the direction of the arrow while in operation. In the read section 2, there are disposed two roller shafts 13, 14, to which sprockets 15, 16 are respectively fixed. The two roller shafts 13, 14 are rotated by a drive system (not shown) of the facsimile apparatus through the sprockets 15, 16.

On the roller shafts 13, 14, rollers 19, 20 are respectively mounted. The roller 19 and a roller 23 fixed to a shaft 21 form a roller pair while the roller 20 and a roller 24 fixed to a shaft 22 also form another roller pair.

The rollers 19, 20 are rotated counterclockwise so that each original document is transported to the right in FIG. 2. During this movement of the original document, light from a light source 25 is projected onto the original document and the light reflected by the surface of the original document is detected by a light receiving element 26, so that the image information appearing on the original document is photoelectrically read by the light receiving element 26. Furthermore, a photoelectric detector 27 for detecting the passage of each original document is disposed in the read section 2.

Referring to FIGS. 3 to 19, there are shown various portions and perspectives of an embodiment of a sheet feeding apparatus of the invention.

Figure 9:
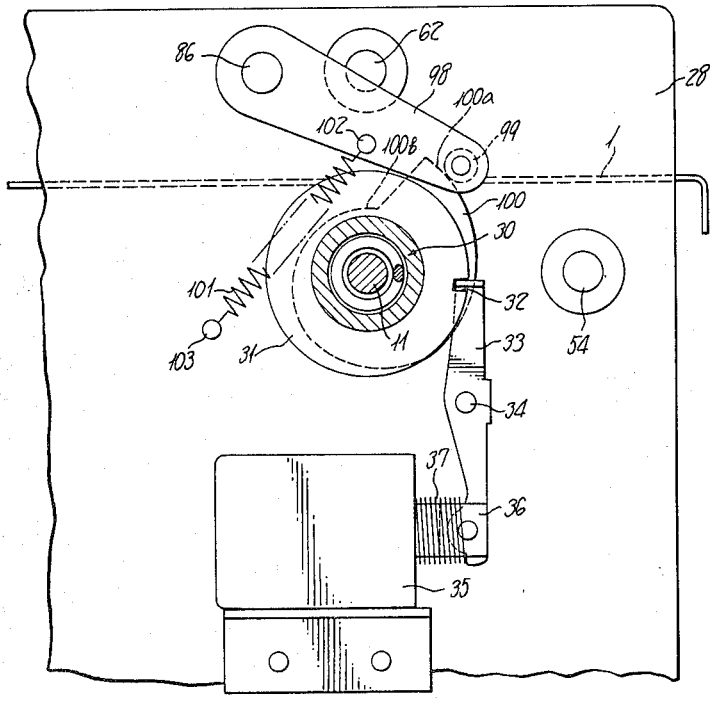
FIG. 9 is a section taken on line IX—IX in FIG. 3.
Figure 3:
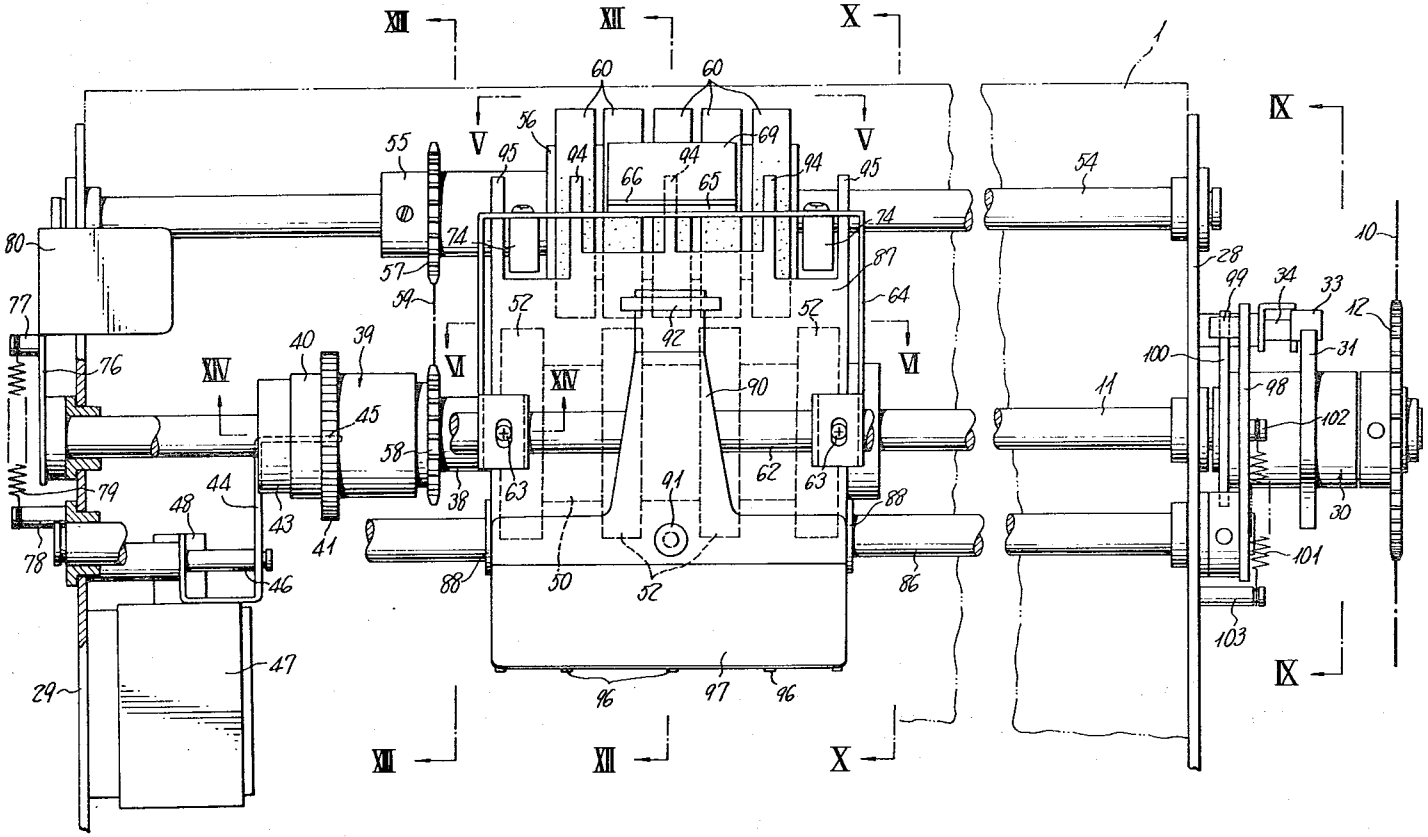
FIG. 3 is a plan view of the main portion of an embodiment of a sheet feeding apparatus according to the invention, from which an original tray for the sheet feeding apparatus is omitted.
Figure 8:
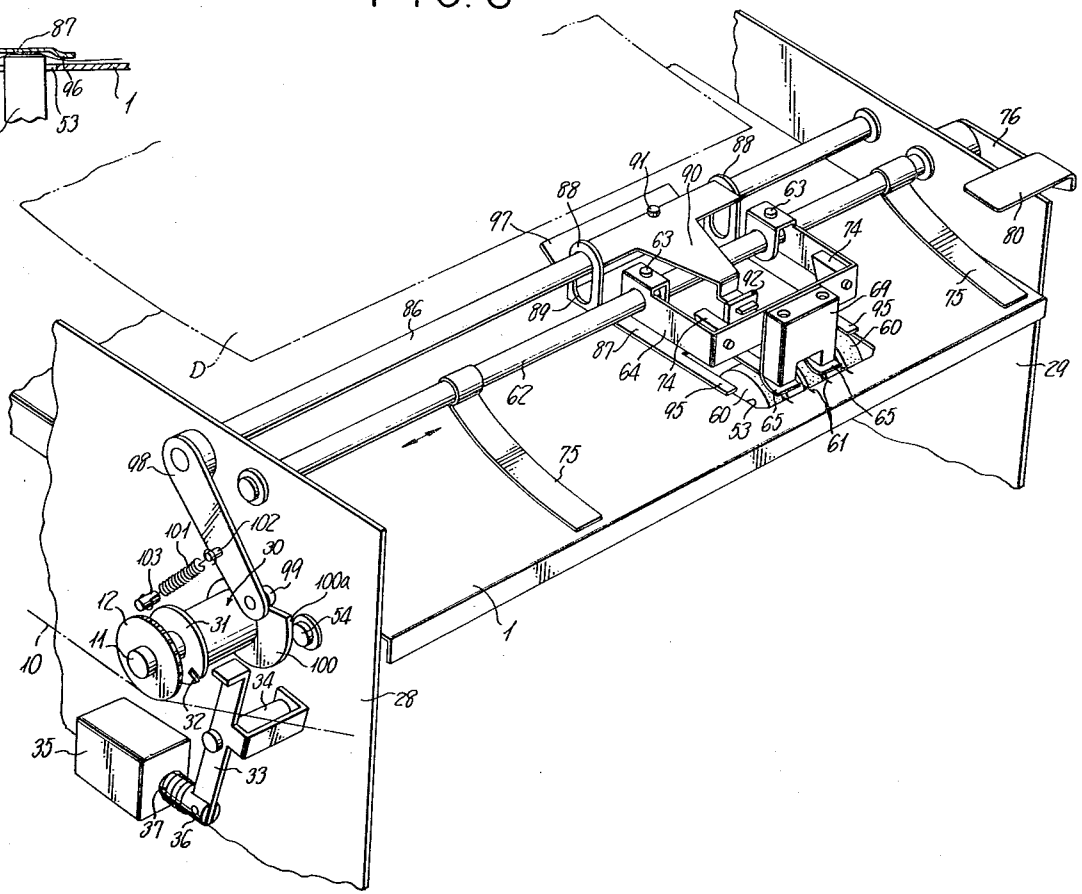
FIG. 8 is a perspective view of the main portion of the embodiment of FIG. 3.

As may be best seen in FIGS. 3, 8 and 9, the drive shaft 11 is supported rotatably by side plates 28, 29 which are disposed on the opposite sides of the original tray 1. The roller drive shaft 11 is provided with a clutch 30. The clutch 30 serves to connect a disc cam 100, which is rotatably mounted on the roller drive shaft 11, to the roller drive shaft 11, and to disconnect the disc cam 100 from the roller drive shaft. The clutch 30 is integral with the disc cam 100. The clutch 30 disconnects the roller drive shaft 11 from the disc cam 100 when the first end of a lever 33 engages a notch 32 formed in the clutch disc 31. On the other hand, when the lever 33 does not engage the notch 32, the clutch 30 connects the roller drive shaft 11 to the disc cam 100. The lever 33 is pivotally mounted on a shaft 34. The second end of the lever 33 is connected to a plunger 36 of a first solenoid 35. When the first solenoid 35 is energized, it rotates the lever 33 clockwise in FIGS. 8 and 9 against the resilience of a spring 37. When the first solenoid 35 is deenergized, the first end of the lever 33 is resiliently brought into pressure contact with the peripheral surface of the clutch disc 31 by the resilience of the spring 37, so that the lever 33 is caused to engage the notch 32.

Figure 14:
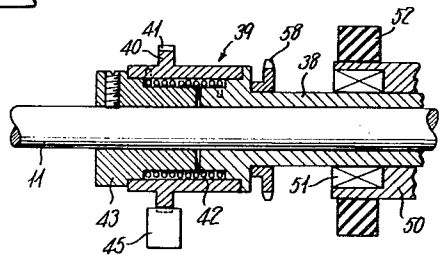
FIG. 14 is a section taken on line XIV—XIV in FIG. 3.
Figure 13:
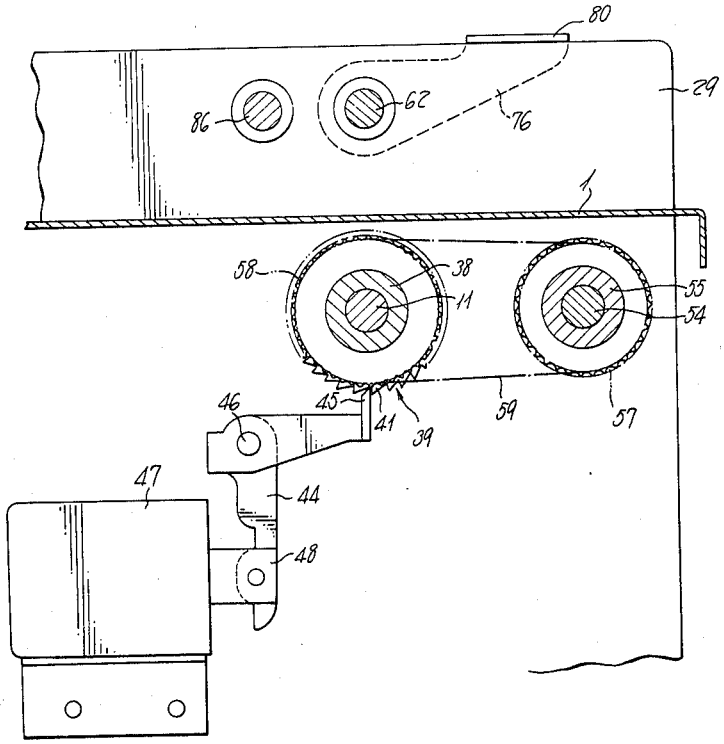
FIG. 13 is a section taken on line XIII—XIII in FIG. 3.

As may best be seen in FIGS. 3, 13 and 14, a sleeve 38 is mounted on the roller drive shaft 11 so as to be rotatable thereon between the side plates 28, 29. A spring clutch 39 is disposed between the sleeve 38 and the roller drive shaft 11. The spring clutch 39 is provided with a clutch sleeve 40 having a ratchet wheel 41. When a pawl 45 formed at one end of a lever 44 engages one of the teeth of the ratchet wheel 41, the rotation of the clutch sleeve 40 is stopped, and since a spring 42 is not made to wind around a drive sleeve 43, the roller drive shaft 11 is disconnected from the sleeve 38.

In contrast to this, when the pawl 45 disengages from the ratchet sheel 41, leaving the clutch sleeve 40 free to rotate, the spring 42 is caused to wind around the drive sleeve 43, so that the roller drive shaft 11 is connected to the sleeve 38 so as to transmit a predetermined torque between them. One end of the lever 44 is pivotally mounted on a shaft 46, while the other end of the lever 44 is connected to a plunger 48 of a second solenoid 47. When the second solenoid 47 is energized, the lever 44 is turned clockwise in FIG. 13, so that the pawl 45 disengages from the ratchet wheel 41. On the other hand, when the second solenoid 47 is deenergized, the lever 44 is turned counterclockwise, so that the pawl 45 engages with one of the teeth of the ratchet wheel 41.

Another sleeve 50 is fitted on the peripheral surface of the sleeve 38, and a one-way clutch 51 is disposed between the sleeves 38, 50. The one-way clutch 51 transmits only the clockwise rotation force of the sleeve 38 in FIG. 13 to the sleeve 50, so that clockwise rotation of the sleeve 50 in FIG. 13 is permitted when the sleeve 38 is stopped.

Figure 4:
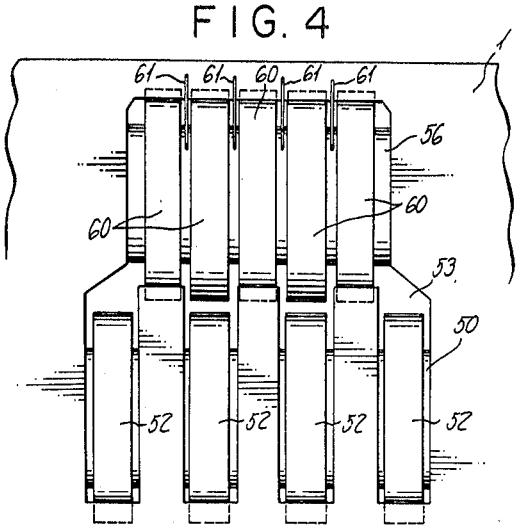
FIG. 4 is a plan view of the arrangement of rollers of the embodiment of the sheet feeding apparatus in FIG. 3.
Figure 6:
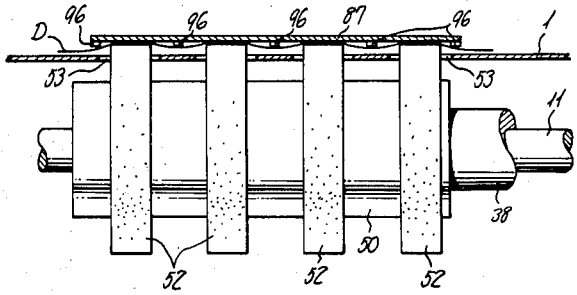
FIG. 6 is a section taken on line VI—VI in FIG. 3.

As may be best seen in FIGS. 3, 4 and 6, the sleeve 50 supports a plurality of sheet feed rollers 52 (four sheet feed rollers are illustrated in this embodiment) fixed thereto which are disposed with predetermined spaces between them in the axial direction thereof. The sheet feed rollers 52 are disposed in such a manner that part of the peripheral surface of each feed roller 52 is projected upwards from each of the corresponding openings 53 formed in the original tray 1. The sheet feed rollers 52 can be made of rubber or a material similar to rubber.

Figure 10:
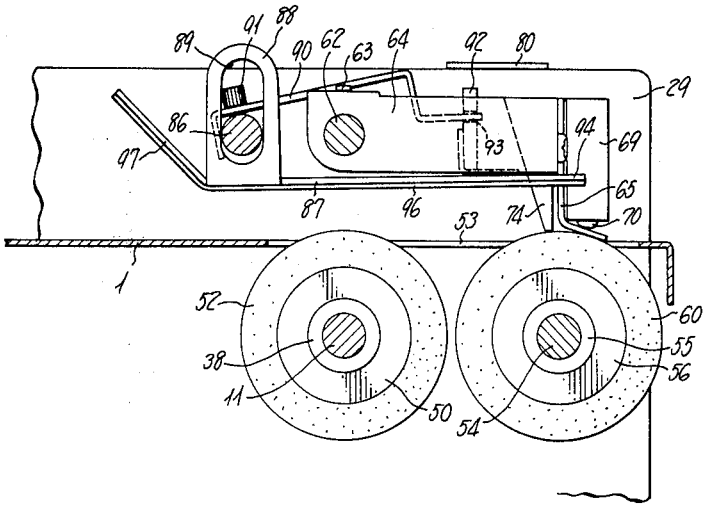
FIG. 10 is a section taken on line X—X in FIG. 3.

Referring to FIGS. 3 and 10 to 13, a sheet separation roller drive shaft 54 is disposed at a predetermined position downstream from the roller drive shaft 11 in terms of the sheet transport direction. The sheet separation roller drive shaft 54 is rotatably supported below the original tray 1 by the side plates 28, 29 while the shaft 54 supports a sleeve 55 stationarily. A sleeve 56 is fitted around the peripheral surface of the sleeve 55 and a one-way clutch (not shown) is disposed between the sleeves 56 and 55. This one-way clutch serves to transmit only the clockwise rotation of the sleeve 55 in FIG. 10 to the sleeve 56, as in the case of the one-way clutch 51, so that the clockwise rotation of the sleeve 56 in FIG. 10 is permitted if the sleeve 55 is stopped. A sprocket 57 is formed integrally with the sleeve 55, and an endless chain 59 is trained over the sprocket 57 and a sprocket 58 attached to the sleeve 38.

Figure 5:
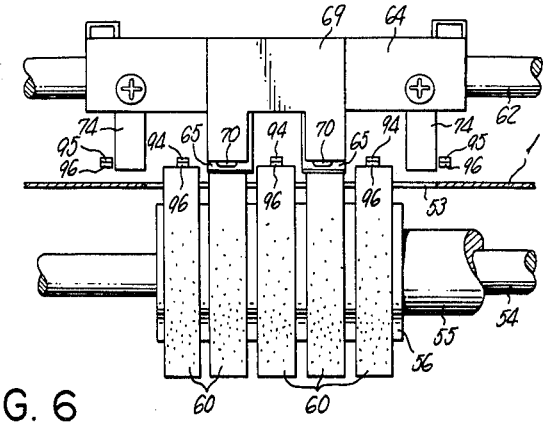
FIG. 5 is a section taken on line V—V in FIG. 3.
Figure 11:
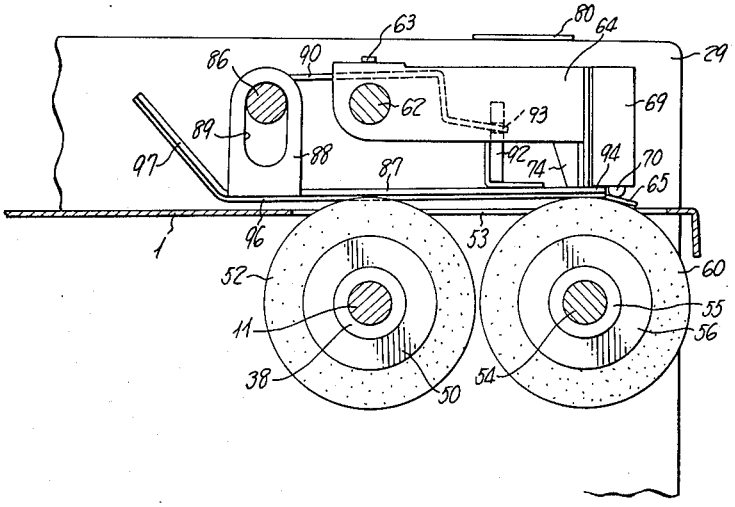
FIG. 11 is a section taken on line X—X in FIG. 3, in which the pressure plate is lowered.
Figure 12:
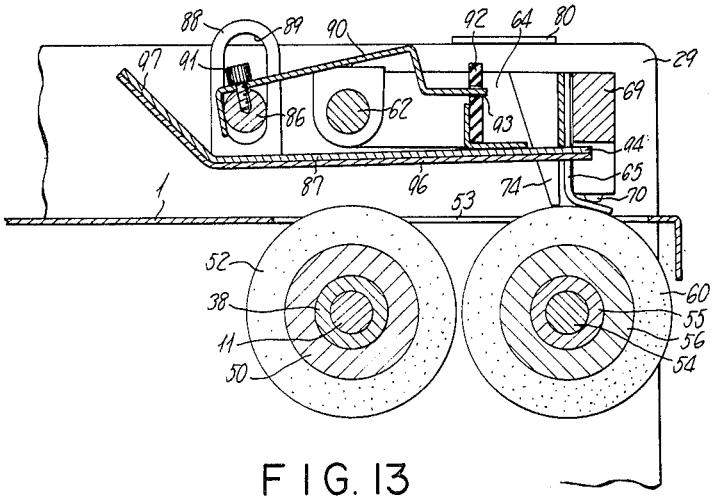
FIG. 12 is a section taken on line XII—XII in FIG. 3.

As may be best seen in FIGS. 3, 4 and 5, the sleeve 56 supports a plurality of sheet separation rollers 60 (five sheet separation rollers are illustrated in this embodiment) fixed thereto, which are disposed with a predetermined space between them in the axial direction thereof. The sheet separation rollers 60 are disposed in such a manner that part of the peripheral surface of each sheet separation roller 60 is projected upwards from openings 53 formed in the original tray 1, correspondingly to the sheet separation rollers 60. The upward projection of the separation rollers 60 is almost the same as that of the aforementioned sheet feed rollers 52 as shown in FIGS. 10 to 12. The sheet separation rollers 60 can be made of rubber or a material similar to rubber.

Figure 15:
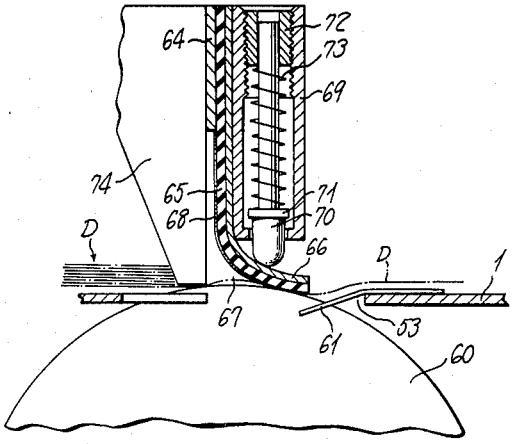
FIG. 15 is an enlarged cross-sectional view of a sheet separation roller, a brake member and a stopper member for the embodiment of the sheet feeding apparatus of the invention.
Figure 16:
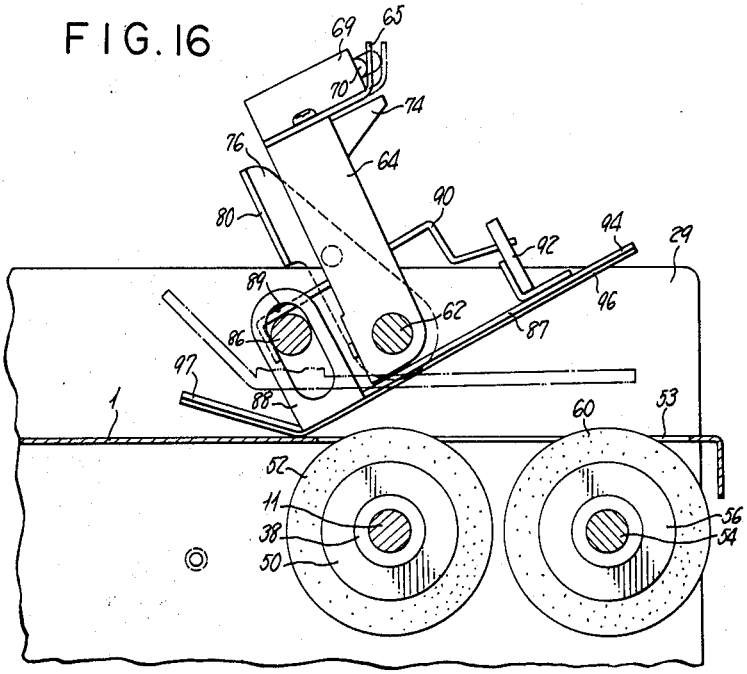
FIG. 16 is a section taken on line X—X in FIG. 3 showing how a jammed sheet can be removed from the sheet feeding apparatus of the invention.
Figure 17:
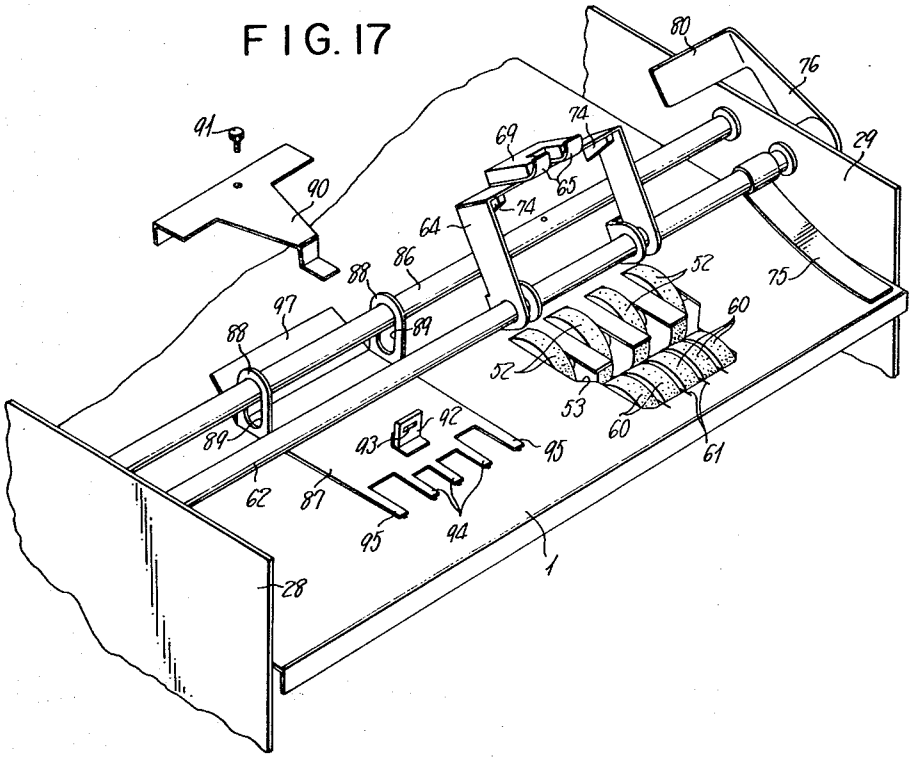
FIG. 17 is a perspective view of the main portion of the embodiment of the sheet feeding apparatus of the invention when it is cleaned.

Further, as shown in FIGS. 4, 8 and 15, the original tray 1 is provided with guide members 61 for preventing the original documents from entering under the original tray 1.

Referring to FIGS. 3, 5, 8, 10 to 12 and 15, the side plates 28, 29 support a shaft 62 rotatably above the original tray 1. The shaft 62 supports the opposite ends on one side of a yoke-shaped support frame 64 which are fixed thereto by screws 63. The one end of the other side of the support frame 64 is attached one end of a superimposed member comprising a brake plate 65 made of a rubber material, such as urethane rubber, and a plate spring 66 which constitutes a backing of the brake plate 65. The brake plate 65 at the other end of the superimposed member is in contact with the outer peripheral surface of a sheet separation roller 60 so as to form a wedge-shaped space 67 between them (FIG. 15). In the case of this embodiment, two brake plates 65 are provided and each brake plate 65 is in sliding contact with its corresponding sheet separation roller 60. On the surface of each brake plate 65 at the inlet portion of the wedge-shaped space 67, except the surface area thereof in contact with the separation roller 60, there is formed a highly smooth layer 68, which is made of, for example, fluorine-contained resin. Each brake plate 65 is resiliently pressed against the outer peripheral surface of the separation roller 60 by the plate spring 66 and, at the same time, by a pressure contact rod 70 which is supported by a support case 69.

The pressure contact rod 70 is urged downwards in FIG. 15 by a compression coil spring 73 which is held between a flange portion 71 of the contact rod 70 and a plug 72 which is fastened with screws to the support case 69. The amount of the force applied to the brake plate 65 by the compression coil spring 73 can be adjusted by changing the screwed-in depth of the plug 72.

The yoke-shaped support frame 64 is provided with stopper members 74 upstream from the brake plates 65 in terms of the original document transportation direction. The stopper members 74 are disposed on the opposite sides of each brake plate 65. The lower end of each stopper member 74 is positioned at the same level as that of the upper peripheral surface of the separation roller 60 or slightly lower than the upper peripheral surface of the same, so that only a limited number of original documents on the original tray 1 can pass below the lower end of each stopper member 74. The lower surface of each stopper member 74 is inclined in such a manner that the lower original documents are advanced relative to the upper original documents. The shaft 62 is provided with a pair of guide members 75 for guiding the original document into the read section 2, while preventing the original document, in particular, the opposite sides thereof, from being curled upwards (refer to FIG. 8).

Figure 18:
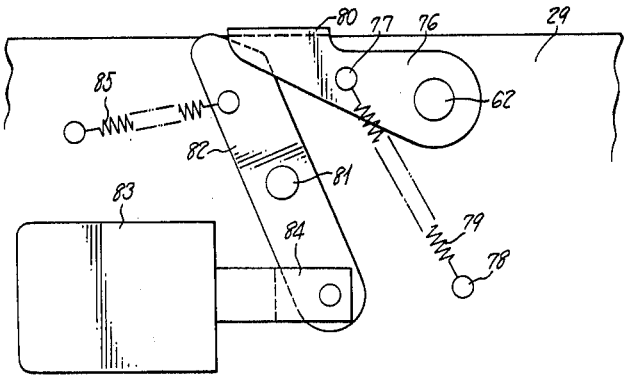
FIG. 18 is a side view of FIG. 3 when a solenoid is deenergized.
Figure 19:
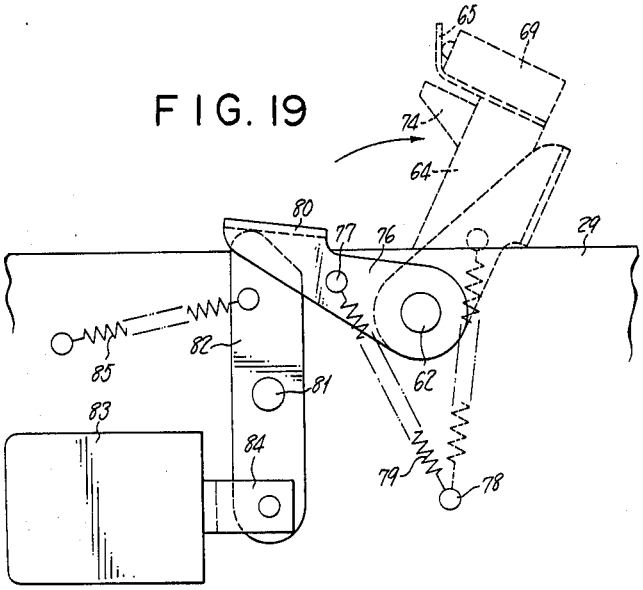
FIG. 19 is a side view of FIG. 3 when the solenoid in FIG. 18 is deenergized.

As shown in FIGS. 3, 8 and 16 to 19, a lever 76 is attached to one end of the shaft 62. The lever 76 is rotatable between a position shown in FIGS. 8 and 18 and a position shown in FIGS. 16 and 17. The lever 76 can be held at either of the above-mentioned two positions by an extensible coil spring 79 connected between a pin 77 attached to the lever 76 and a pin 78 attached to the side plate 29. When the lever 76 is at the position shown in FIGS. 8 and 18, the support frame 64 is at an operation position shown in FIGS. 8 and 18. On the other hand, when the lever 76 is at the position shown in FIGS. 16 and 17, the support frame 64 is at an upward, inoperable position. When a jammed document is removed or when cleaning is done, the support frame 64 is brought to this inoperable position. At one end of the lever 76, there is formed a pick-up portion 80. As shown in FIGS. 18 and 19, the side plate 29 pivotally supports a lever 82 by a pin 81. One end of the lever 82 is connected to a plunger 84 of a solenoid 83, so that when the solenoid 83 is deenergized, the lever 82 is held at a position away from the lever 76 as shown in FIG. 18 by the resilience of the extensible coil spring 85. When the solenoid 83 is energized, the lever 82 is rotated clockwise about the pin 81 in FIG. 18 to a predetermined angle, approximately 30° in this embodiment, whereby the other end of the lever 82 engages with the pick-up portion 80 of the lever 76, moving the lever 76 upwards and rotating the shaft 62 counterclockwise in FIG. 8. As a result, the support frame 64 is moved upwards. The solenoid 83 is energized when sheet jam is detected.

Figure 7:
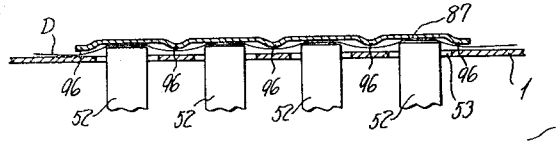
FIG. 7 is a pressure plate for the embodiment of the invention.

As shown in FIGS. 3 and 8 to 11, the side plates 28, 29 support a shaft 86 rotatably above the original tray 1 and upstream of the shaft 62 in terms of the direction of original document transportation. The shaft 86 engages a vertical slot 89 formed in a bracket 88 which is disposed at one end of a pressure plate 87, whereby the pressure plate 87 is supported swingably by the shaft 86. Further, one end of a drive lever 90 is fixed to the shaft 86 by a screw 91 in such a manner that the shaft 86 supports the drive lever 90. The other end of the drive lever 90 engages a hole formed in a resilient bracket 92 which is disposed in proximity to the other end of the pressure plate 87. The pressure plate 87 faces the sheet feed roller 52, and the forward portion of the pressure plate 87 is in the shape of the teeth of a comb and extends over the separation roller 60. Three teeth 94 in the central top portion of the pressure plate 87 are positioned alternately with each of the brake plates 65 and face the peripheral surface of the separation roller 60 in the area where the brake plates 65 are not in contact with the separation roller 60 (FIG. 5). The teeth 95 on the opposite sides of the pressure plate 87 are located outside of the stopper member 74. The pressure plate 87 is provided with crosspiece members 96 on the lower surface thereof along the teeth thereof. Each crosspiece member 96 is disposed between the sheet feed rollers 52 as shown in FIG. 6. The crosspiece members 96 can be formed integrally with the pressure plate 87 by press-molding of the pressure plate 87 as shown in FIG. 7. On the opposite side of the pressure plate 87 to the tooth side thereof, an inclined plate 97 is disposed.

As may be best seen in FIGS. 3, 8 and 9, one end of a lever 98 is supported by one end portion of the shaft 86. To the other end of the lever 98, a cam follower 99 is attached. The cam follower 99 is in pressure contact with the disc cam 100 attached to the roller drive shaft 11, by the resilience of a spring 101, which is connected between a pin 102 attached to the lever 98 and a pin 103 attached to the side plate 28. When the lever 33 engages the notch 32 formed in the clutch disc 31, the cam follower 99 engages a top portion 100*a* of the disc cam 100 as shown in FIG. 9, holding the pressure plate 87 upwards as shown in FIGS. 10 and 12. In contrast to this, when the lever 33 disengages from the notch 32 and the disc cam 100 follows the roller drive shaft 11, rotating clockwise in FIG. 9, the cam follower 99 engages a bottom portion 100*b* of the disc cam 100, so that the shaft 86 is rotated clockwise in FIG. 9 and the pressure plate 87 is moved downwards to the position as shown in FIG. 11 (hereinafter referred to as the descent position). When the pressure plate 87 is at the descent position as shown in FIG. 11, the forward ends of the crosspiece members 96 attached to the pressure plate 87 are in contact with the upper peripheral surfaces of alternate separation rollers 60, as shown in FIG. 5. The disc cam 100 is designed such that the pressure plate 87 is moved downwards to a position where the original document whose leading edge has been in contact with the stopper members 74 comes to be held between the separation rollers 60 and the brake plate 65.

More specifically, the cam edge of the disc cam 100 is designed in such a manner that when a stack of original documents on the original tray 1 is high, the pressure plate 87 holds the stack of original documents for a long time, while when the the stack of original document on the tray 1 is low, the pressure plate 87 holds the document stack for a short time. The "short time" signifies a period of time required for at least the leading edge of the bottom original document to be held between the separation rollers 60 and the brake plate 65.

The thus constructed sheet feeding apparatus is operated as follows.

A stack of original document D is placed on the tray 1. At this stage, the lever 33 engages the notch 32 of the clutch disc 31 as shown in FIG. 9. Further, the cam follower 99 engages the top portion 100*a* of the disc cam 100, so that the pressure plate 87 is held at the upper position as shown in FIGS. 10 and 12. Therefore, at this moment, a plurality of original documents D can be inserted between the tray 1 and the pressure plate 87 to a position where their leading edges come into contact with the stopper member 74. When such setting of the original documents D on the tray 1 has been completed, an automatic continuous sheet feeding button 6 is depressed, whereby the first and second solenoids 35, 47 are energized. When the first solenoid 35 is energized, the lever 33 is rotated clockwise in FIG. 9, disengaging from the notch 32 of the clutch disc 21, so that the clutch 30 is connected and the rotation of the roller drive shaft 11 (which is always rotated) is transmitted to the disc cam 100. As a result, the disc cam 100 is rotated clockwise in FIG. 9, and the cam follower 99 disengages from the top portion 100*a* and engages with the bottom portion 100*b*. At that moment, the pressure plate 87 is moved downwards to the descent position as shown in FIG. 11. At that moment, the tooth portion 94 of the pressure plate 87 is brought into pressure contact with the upper peripheral surface of alternate separation rollers 60 while the rear end portion of the pressure plate 87 brings the original documents D into pressure contact with the sheet feed rollers 52. As the number of original documents D placed on the tray 1 decreases, a portion of the pressure plate 87 above the sheet feed rollers 52 is slightly moved downwards from the upper peripheral surfaces of the sheet feed rollers 52 while each crosspiece member 96 is located between the sheet feed rollers 52, applying soft pressure to the original documents D and causing them to wave, to produce a resilience in the original document D. As mentioned previously, when the second solenoid 47 is energized, the lever 44 is rotated clockwise in FIG. 13 and the pawl 45 disengages from the ratchet wheel 41 disposed in the clutch sleeve 40, and the spring clutch 39 is connected so as to transmit the rotation of the roller drive shaft 11 to the sleeve 38.

The rotation of the sleeve 38 is transmitted to the sheet feed rollers 52 via the one-way clutch 51 and the sleeve 50 and, at the same time, to the separation rollers 60 via the sprocket 58, endless chain 59, sprocket 57 and sleeves 55 and 56, whereby the rollers 52 and 60 are rotated clockwise in FIG. 11. The original documents D which are in pressure contact with the sheet feed rollers 52 and the separation rollers 60 by the pressure plate 87 are transported to the right in FIG. 11 by the rollers 52 and 60, whereby the original documents D are brought into contact with the stopper members 74, and then the lowermost two or three original documents D pass under the stopper members 74 and their leading edges are caused to enter the wedge-shaped space 67 formed by the separation rollers 60 and the brake plate 65. At that moment, the tooth portion 94 of the pressure plate 87 prevents the leading edges of the original documents D from curling upwards, so that those leading edges are caused to accurately enter the wedge-shaped space 67. Even if the leading edge of an original document D slants upwards within the wedge-shaped space 67, the leading edge collides with the highly smooth layer 68, which moves the leading edge downwards in FIG. 15. As a result, the leading edge enters the wedge-shaped space 67 correctly. The several original documents D whose leading edges have been fed into the wedge-shaped space 67, except the lowermost document, are stopped there by the friction between the documents D and the brake plate 65. As a result, only the lowermost document is further transported to the right in FIG. 15 by the rotation of the separation roller 60 and is then inserted between the rollers 19 and 23 in the read section 2 shown in FIG. 2, to be then further transported to the right in FIG. 2.

When the documents D collide with the brake plate 65, they stop momentarily since the brake plate 65 works as a brake on the transported documents D. In this case, if the documents D are further transported forcibly by the sheet feed rollers 52, the the documents D placed on the tray 1 may be wrinkled, particularly when the documents D are few in number. In this case, however, since the pressure plate 87 only slightly moved downwards so as to bring the documents into only light contact with the sheet feed rollers 52, the rollers 52 do not transport the documents forcibly. Therefore, the documents are not wrinkled even if they collide with the brake plate 65 and are stopped there temporarily. When the leading edge of the document is held between the separation rollers 60 and the brake plate 65 and is then transported by the separation rollers 60, the shaft 86 is rotated counterclockwise in FIG. 9 by the disc cam 100 which is rotated successively. As a result, the pressure plate 87 is elevated from the descent position shown in FIG. 11 to an elevated position shown in FIG. 10, so that the documents are released from the sheet feed roller 52. In this embodiment, the pressure plate 87 which has been at the descent position is elevated as follows: When the shaft 86 is rotated counterclockwise in FIG. 11, the lever 90 is rotated, and the pressure plate 87 is turned counterclockwise about the shaft 86, so that the top portion of the pressure plate is lifted upwards away from the separation rollers 60. When top portion of the plate 87 is contacted with a lower edge 64*a* of the frame 64, the plate 87 is then turned clockwise in FIG. 11 about that contact point, resulting in the plate 87 being moved upwards horizontally as shown in FIG. 12.

When the leading edge of a separated document reaches the photoelectric detector 27 and is detected by the detector 27, the rotation of the rollers 19, 20 (FIG. 2) is stopped and therefore the document is also stopped there. At this moment, the first and second solenoids 35 and 47 are also de-energized. Therefore, the lever 44 is rotated counterclockwise in FIG. 13, and the pawl 45 engages one of the teeth of the ratchet wheel 41 of the clutch sleeve 40, so that the spring clutch 39 is disconnected. The lever 33 is rotated counterclockwise in FIG. 9, and one end thereof is brought into pressure contact with the outer peripheral surface of the clutch disc 31. When the facsimile apparatus on the reception side is ready, the rollers 19, 20 that have been stopped are driven so that they are rotated counterclockwise in FIG. 2 and the document is transported to the right in FIG. 2. During the transportation, the information borne on the original document is read photoelectrically by the light source 25 and the light receiving element 26, and the sheet feed rollers 52 and the separation rollers 60 are set free and rotated by the transportation of the document. The lever 33 engages the notch 32 of the clutch disc 21, and the clutch 30 is disconnected to that the rotation of disc cam 100 is stopped. As a result, the cam follower 99 engages the top portion 100*a* of disc cam 100 as shown in FIG. 9, so that the pressure plate 87 is held at the elevated position as shown in FIGS. 10 and 12.

When the rear end of the original document reaches the photoelectric detector 27 and is detected by the detector, the first and second solenoids 35, 47 are again energized. The above-mentioned procedure is repeated until all the original documents placed on the tray 1 are transported therefrom.

According to the invention, only when sheets such as original documents are transported by the sheet feed rollers, a pressure application member such as the pressure plate 87 brings the next successive sheet to the sheet feed rollers, so that sheet feeding can be performed accurately and smoothly.

What is claimed is:

1. An apparatus for individually feeding a plurality of sheets, comprising:

a tray for receiving a stack of sheets thereon;

means including at least one sheet separation roller having a portion of its peripheral surface extending upwardly through said tray and a brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a second position away from said sheet feed roller for releasing said sheets from pressure contact with said sheet feed roller; and drive means associated with said pressure plate for moving said pressure plate into its second position during the period of time the leading edge of a sheet between said sheet separation roller and said brake member.

2. An apparatus as set forth in claim 1, including respective guides lying adjacent the sides of each said brake member for guiding said sheets between said sheet separation roller and each said brake member.

3. An apparatus as set forth in claim 2, wherein each said guide is formed on the forward portion of said pressure plate.

4. An apparatus as set forth in claim 3, including a plurality of stopper members located in the path of sheet movement between said sheet feeding roller and said brake member for stopping the advancement of all but a few of said sheets towards said brake member.

5. An apparatus as set forth in claim 4, including means for moving said stopper members out of said path of sheet movement.

6. An apparatus as set forth in claim 4, said stoppers member each having an inclined surface for engaging said sheets whereby the lower sheets can advance to a position forward that of upper sheets.

7. An apparatus as set forth in claim 4, these being two of said stopper members with a sheet separation roller therebetween.

8. An apparatus for individually feeding a plurality of sheets, comprising:

a tray for receiving a stack of sheets thereon;

means including at least one sheet separation roller having a portion of its peripheral surface extending upwardly through said tray and brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a second position away from said sheet feed roller for releasing said sheets from pressure contact with said sheet feed roller; and drive means associated with the pressure plate for moving said pressure plate into its second position during the period of time the leading edge of a sheet is between said sheet separation roller and said brake member;

there being a plurality of sheet feed rollers spaced across the path of movement of said sheets, said pressing plate being continually held out of contact with said sheet feed rollers but having portions extending between said sheet feeding rollers.

9. An apparatus as set forth in either claim 1 or 8, said pressure plate having a shaft holding its rear portion and being swingable about the axis of said shaft for movement into its second position, the rear portion of said pressure plate angling upwardly.

10. An apparatus as set forth in claim 1, including retract means for moving each said brake member out of the path of movement of said sheets.

11. An apparatus as set forth in claim 10, said retract means including a support frame carrying each said brake member and held rotatably to the frame for said apparatus for movement between a first location placing each said brake member in the path of movement of said sheets and a second location out of the path of movement of said sheets.

12. An apparatus as set forth in claim 11, said support frame being held to said frame of the apparatus by a shaft having an operation lever operated manually and attached thereto for manually moving said brake member into either of its two locations.

13. An apparatus for individually feeding a plurality of sheets, comprising:

a tray for receiving a stack of sheets thereon;

means including at least one sheet separation roller having a portion of its peripheral surface extending upwardly through said tray and a brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a second position away from said sheet feed roller for releasing said sheets from pressure contact with said sheet feed roller;

drive means associated with said pressure plate for moving said pressure plate into its second position during the second period of time the leading edge of a sheet is between said sheet separation roller and said brake member;

retract means for moving each said brake member out of the path of movement of said sheets; said retract means including a support frame carrying each said brake member and held rotatably to the frame for said apparatus for movement between a first location placing each said brake member in the path of movement of said sheets and a second location out of the path of movement of said sheets; said support frame being held to said frame of the apparatus by a shaft, and including a first lever fixed to said shaft; and means, including a solenoid connected to said first lever, for rotating said shaft upon jamming of a sheet so as to retract said brake member.

14. An apparatus as set forth in claim 1, including a plurality of said sheet separation rollers spaced across the path of movement of said sheets.

15. An apparatus as set forth in claim 1, each of said sheet separation rollers having a peripheral surface formed of a resilient material having a high coefficient of friction.

16. An apparatus as set forth in claim 1, the surface of said brake member being formed of a material having a high coefficient of friction.

17. An apparatus as set forth in claim 1, said brake member being formed of a rubber member having a resilient backing plate.

18. An apparatus as set forth in claim 1, said brake member and said sheet separation roller forming a wedged-shaped space narrowing gradually in the direction of movement of said sheets.

19. An apparatus as set forth in claim 18, the portion of said brake member serving to define said wedge-shaped space that does not engage said sheet separation roller having a highly smooth surface.

20. An apparatus as set forth in claim 1, including means for rotating said sheet feed rollers, said rotating means comprising a drive motor, a drive shaft continuously rotated by said motor, a clutch operable to connect or dis-connect each sheet feed roller to said drive shaft, and a solenoid for operating said clutch.

21. An apparatus as set forth in claim 20, including a sleeve member fitted over said drive shaft and connected for rotation therewith by a one-way clutch enabling free rotation of each of said sheet feed rollers in the direction for feeding sheets.

22. An apparatus as set forth in claim 20, including a sleeve member fitted over said drive shaft and having a sprocket fixed thereto, each said sheet separation roller being supported on a rotatable shaft having a sprocket fixed thereto, and an endless chain being trained over said two sprockets, each said sheet separation roller being adapted to rotate freely in the direction for feeding sheets.

23. An apparatus according to claim 20, said clutch being a spring clutch.

24. An apparatus for individually feeding a plurality of sheets, comprising:

a tray for receiving a stack of sheets thereon;

means including at least one sheet separation roller having a portion of its peripheral surface extending upwardly through said tray and a brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a second position away from said sheet feed roller for releasing said sheets from pressure contact with said sheet feed roller; and drive means associated with said pressure plate for moving said pressure plate into its second position during the period of time the leading edge of a sheet is between said sheet separation roller and said brake member; said drive means including a shaft, a disc cam and a clutch connecting said disc cam for rotation with said shaft, and means including a lever actuated by a solenoid for operating said clutch to rotate said disc cam; a cam follower held in contact with said disc cam and connected to a pivot shaft, said pressure plate being connected to said pivot shaft whereby upon one revolution of said disc cam, said pressure plate is first lowered against the documents over said sheet feed roller and thereafter retracted therefrom when said sheets extend between said brake member and said sheet separation roller.

25. An apparatus as set forth in claim 1, said brake member being provided with means for adjusting the pressure said brake member applies against said sheet separation roller.

26. An apparatus as set forth in claim 25, said adjusting means comprising a pressure rod, a spring member for urging said pressure rod against said brake member, and a plug member held against said spring member, said plug member being movable to adjust the pressure said spring member applies to said rod.

27. An apparatus as set forth in claim 1, said tray having a respective opening for receiving the peripheral surface of each sheet separation roller, and a plurality of guide members extending across said openings in the direction of sheet movement for guiding said sheets passed said openings.

28. An apparatus as set forth in either claim 1 or claim 27, guide straps ar provided on respective sides of said tray for urging said sheets thereagainst.

29. An apparatus for individually feeding a plurality of sheets, comprising:

a tray for receiving a stack of sheets thereon;

means including at least one sheet separation roller having a portion of its peripheral surface extending upwardly through said tray and a brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a position away from said sheet feed roller for releasing said sheets from pressure contact with said sheet feed roller; said pressure plate having a plurality of projections extending forwardly into engagement with the peripheral surfaces of respective sheet separation rollers; and drive means associated with said pressure plate for moving said pressure plate into its second position during the period of time the leading edge of a sheet is between said sheet separation roller and said member.

30. An apparatus as set forth in claim 1, said pressure plate urging said sheets against both each said sheet feeding roller and each said sheet separation roller.

31. An apparatus for individually feeding a plurality of sheets comprising:

a tray for receiving a stack of sheets thereon;

means including at least one sheet separation roller having a portion of its peripheral surface extending upwardly through said tray and a brake member urged against the peripheral surface of said sheet separation roller for feeding sheets individually from beneath said brake member;

means including at least one sheet feed roller located upstream from said sheet separation roller and having a peripheral surface extending upwardly through said tray for feeding sheets stacked on said tray to said sheet separating roller;

means including a pressure plate movable into a first position pressing sheets stacked on said tray against said sheet feed roller for feeding said sheets toward said sheet separation roller and thereafter into a second position away from said sheet feed roller for releasing said sheets from pressure contact with said sheet feed roller; and drive means associated with said pressure plate for moving said pressure plate into its second position during the period of time the leading edge of a sheet is between said sheet separation roller and said brake member;

there being a plurality of sheet feed rollers spaced across the path of movement of said sheets, and said pressure plate including a plurality of pressure members formed on its under surface and adapted to extend between the peripheral surfaces of adjacent sheet feed rollers.

* * * * *